US005758473A

United States Patent [19]

Patelli

[11] Patent Number: 5,758,473

[45] Date of Patent: Jun. 2, 1998

[54] METHOD FOR MANUFACTURING PACKAGES FOR LIQUID PRODUCTS, ESPECIALLY LIQUID FOODSTUFFS AND A PACKAGE OBTAINED THROUGH THIS METHOD

[76] Inventor: Ferruccio Patelli, Bologna, Via Speranza 52, Italy

[21] Appl. No.: 637,707

[22] PCT Filed: Nov. 2, 1994

[86] PCT No.: PCT/IT94/00183

§ 371 Date: Apr. 26, 1996

§ 102(e) Date: Apr. 26, 1996

[87] PCT Pub. No.: WO95/12530

PCT Pub. Date: May 11, 1995

[30] Foreign Application Priority Data

| | | | |
|---|---|---|---|
| Nov. 5, 1993 | [IT] | Italy | BO93A0441 |
| May 27, 1994 | [IT] | Italy | BO94A0250 |

[51] Int. Cl.[6] ..... B65B 61/00; B65B 43/04

[52] U.S. Cl. ..... 53/412; 53/133.1; 53/455; 53/479; 222/541.6; 383/906; 426/85; 426/115; 426/122

[58] Field of Search ..... 383/906; 426/85, 426/115, 122, 123; 222/215, 541.6, 541.5; 53/410, 412, 455, 479, 481, 133.1, 133.2

[56] References Cited

U.S. PATENT DOCUMENTS

| | | | |
|---|---|---|---|
| 2,789,728 | 4/1957 | Britton . | |
| 2,998,340 | 8/1961 | Conway et al. | 383/906 X |
| 3,074,612 | 1/1963 | Schneider | 426/85 |
| 3,144,976 | 8/1964 | Freshour . | |
| 3,171,581 | 3/1965 | Kugler | 383/906 X |
| 3,462,061 | 8/1969 | Shore | 426/85 X |
| 3,473,703 | 10/1969 | Lippincott . | |
| 3,799,914 | 3/1974 | Schmit et al. | 426/85 |
| 4,614,074 | 9/1986 | Evers | 53/410 X |
| 5,228,782 | 7/1993 | Imer | 383/906 X |
| 5,547,284 | 8/1996 | Imer | 383/906 X |

FOREIGN PATENT DOCUMENTS

| | | | |
|---|---|---|---|
| 653252 | 12/1962 | Canada | 426/85 |
| 0 106 648 | 4/1984 | European Pat. Off. . | |
| 1182542 | 6/1959 | France | 383/906 |
| 35 20 451 | 12/1986 | Germany . | |

*Primary Examiner*—Bryon P. Gehman

*Attorney, Agent, or Firm*—McAulay Fisher Nissen Goldberg & Kiel, LLP

[57] ABSTRACT

A method for manufacturing packages (1) for liquid food products, includes a step in which a flexible sheet material member (2) is folded into a tubular shape so that longitudinal strips (6) extends outwardly, and are joined to each other. Along the joined longitudinal strips (6), suitable welding lines (7, 8) are made so as to form a portion (9) in the form of a channel compartment (10) that is closed at one end, and having its other end in communication with an inside of the package. A a longitudinal breaking line (12) is made in the strips to allow the portion (9) to be partially detached from the package. In the strips (6) a notch (13) is made which allows the detachable portion (9) to be opened at the end opposite to the one in communication with the inside of the package (1).

15 Claims, 14 Drawing Sheets

METHOD FOR MANUFACTURING PACKAGES FOR LIQUID PRODUCTS, ESPECIALLY LIQUID FOODSTUFFS AND A PACKAGE OBTAINED THROUGH THIS METHOD

TECHNICAL FIELD

The present invention relates to the packaging of liquid food products.

BACKGROUND ART

Packages are know for liquid foodstuff such as e.g. packages for fruit juice and the like, which are made from flexible or semi-stiff material sheets suitably folded and welded.

These packages sometimes allow one to drink the beverage through a drinking straw or similar means.

More particularly cardboard semi-stiff containers are known, generally having a parallelepiped shape, which are separately provided with a drinking straw the straw being inserted into a hole in the top of the container when used. This hole is usually closed by a patch of material that can be broken by inserting the straw.

These containers however have disadvantages in manufacturing and handling, the containers requiring very high manufacturing costs, particularly because of the material used.

Furthermore, it appears that it is difficult to drink all the beverage since the straw must be moved over the bottom of the container.

It must be noted that generally the straw is bonded to the outer surface of the container, and it can easily get damaged while handling the container.

Instead of the above mentioned semi-stiff containers, other flexible packages have been used, produced in the form of pouches.

Each pouch incorporates at the top a tubular member including an opening device for with-drawing the beverage.

However these packages require very high costs and are not convenient because the tubular member dips in a limited part of the liquid product.

The above mentioned drawbacks of the known packages are more severe when it is considered that these packages are mainly used by very young consumers.

U.S. Pat. No. 3,144,976 discloses a liquid filled pouch having a straw therein for effecting the dispensing of the contents thereof. In particular the pouch is formed from two panel, or from a single folded sheet, of flexible material joined along edges thereof.

The pouch includes a top, a bottom, side edges, and a heat sealed line extending between the panels downwardly from said top so as to separate the pouch into a large main compartment and a smaller dispensing compartment disposed proximal to one side edge for loosely receiving a straw.

The heat sealed line terminates short of the pouch bottom whereby the liquid may flow from the bottom of the main compartment into the bottom of the dispensing compartment.

The main disadvantage of the pouch is that a user could withdraw the liquid contained in the main pouch compartment only by using the straw contained in the dispensing compartment because the dispensing compartment is integral with the main compartment and is not provided with any kind of mouthpiece.

Another disadvantage is that this pouch is not self-supporting, and it cannot lean against a flat surface after its is opened.

A Further disadvantage is that the pouch is made with a single flexible sheet, which results in a consequent slower production rate and high production cost in comparison with a package that can be made from a continuous band of material.

U.S. Pat. No. 3,473,703 discloses a package for storing and dispensing liquids formed by first cutting a continuous sleeve of plastic material to the desired length, and then closing the opposite ends of the resulting section of the sleeve.

This container has a spout for pouring the fluid contents, the spout formed by welding the opposite surfaces of the sectioned sleeve along a predetermined line for a predetreminated portion of the width or length of the container at that point. The weld line is spaced a suitable distance from the edge of the sleeve so as to provide a passageway adjacent the main body portion of the container.

The passageway is in communication with the main body portion by virtue of the fact that the sealing line does not extend the entire length or width of the package.

The passageway can be removed from its position adjacent the container because the sealing line is perforated or distressed so that the passageway means could provide a suitable pouring spout.

This package is particularly well adapted for carrying and pouring fluids such as battery acids or other acids.

The most important disadvantage of this package is that the passageway is integral with, but externally exposed with respect to, the container so that the spout is not well protected as to the liquid contents and thus it may not avoid undesirable contamination and it is difficult to obtain the normal hygiene necessary for using this spout as a mouthpieces for the withdrawal of the liquid contents.

In fact this package is designed to be used with active fluids that do not need to meet any particular hygienic conditions such as those that must be used for human consumption.

Another disadvantage is that this container is not self-supporting and must be carefully handled after its first opening in such a way that the liquid contents could not come out, due to the fact that this container is not re-closable.

DISCLOSURE OF THE INVENTION

The subject of the present invention is therefore a method that allows for manufacturing, in a simple and economical way, of packages for beverages and the like so adapted as to easily permit a complete withdrawal of the beverages.

The above mentioned method comprises the steps of:

mutually juxtaposing longitudinal strips of a flexible sheet material member, that is folded into a tubular shape, in such a manner that said longitudinal strips are turned outwards;

performing welding lines onto said longitudinal strips joined to one another, to define a portion in the form of a channel compartment that is closed at one end while its other end is in communication with the inside of the package;

making a longitudinal breaking line in said joined strips, this breaking line being designed to allow said portion and said channel compartment, to be partially detached from the package when the liquid product contained therein must be withdrawn;

making a transversal notch in said joined strips, the notch being aimed at allowing the detachable portion to be opened at the end opposite to the end in communication with the inside of the package;

making at least one transversal welding line at one end of the tubular member, the welding line extending also over the detachable portion for defining the bottom of the package.

BRIEF DESCRIPTION OF THE DRAWINGS

The characteristic features of the invention are set forth in the following, with reference to the enclosed drawings, in which.

BEST MODE OF CARRYING OUT THE INVENTION

Figure 3:
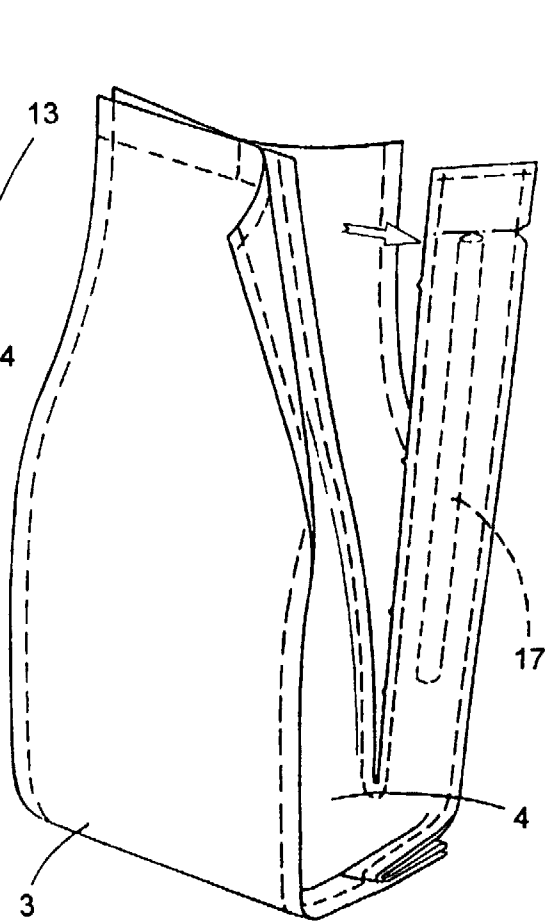
FIG. 3 shows a different embodiment of the package in the same situation as the one shown in FIG. 2.

With reference to the above mentioned figures, a package 1 is made from a flexible material and used to contain liquid products, in particular liquid food products.

The package 1 is obtained by starting from a member 2 of a flexible sheet material, folded into a tubular shape, preferably having a rectangular cross section.

More precisely, the tubular member 2, when considered in its longitudinal dimension, has front and back faces 3 and sides 4 disposed opposite each other respectively; moreover, the longitudinal corners 2*a* of the tubular member 2 are suitably folded and stiffened by means of welding lines 5.

Figure 1:
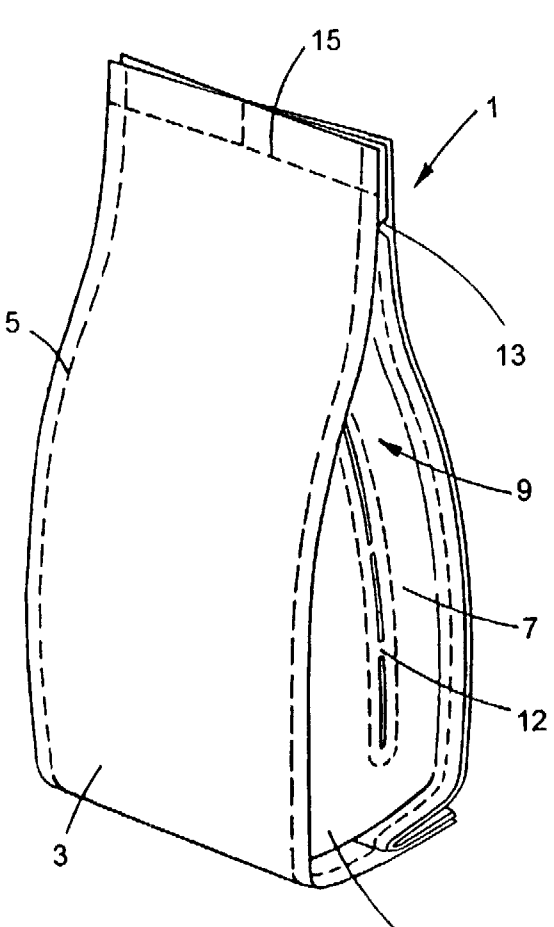
FIG. 1 is a perspective view of a package manufactured in accordance with the subject method.

The tubular member 2 has a couple of longitudinal strips 6 turned outwardly, which are to be joined to each other. In the embodiment of FIG. 1, these longitudinal strips 6 extend symmetrically in correspondence with a median line of a side 4 of the tubular member 2.

Near the edge of the longitudinal strips 6, respective welding lines 7 and 8 are made, which are respectively called internal and external welding lines respectively; the welding lines 7 and 8 to form, longitudinally to the same strips 6, a portion 9 in a form of a channel compartment 10, closed at one top end and having the other bottom end in communication with the inside of the package 1.

For that purpose, the internal welding line 7 is suitably broken at one end and joined to the external welding line 8 at the other end, by another welding line 11, drawn transversally to the portion 9.

It is to be pointed out that the welding lines 7, 8 and 11 are aimed at keeping the package in a liquid-tight condition.

Also a longitudinal breaking line 12 is made in the joined longitudinal strips 6, in correspondence with the internal welding line 7, with the aim of allowing the portion 9, in the form of the channel compartment 10, to be partially detached from the package during its use.

In fact, the internal welding line 7 is double welded, so as to tighten both the tubular member 2 and the channel compartment 10, and the above mentioned breaking line 12 extends in the middle region delimited by the double welded line 7.

A transversal tear notch 13 is made on the external edge of the partially detachable portion 9, adjacent to the welding line 11; the notch 13 is aligned with a preferential breaking line 14, drawn transversally to the detachable portion 9 and designed to permit the opening of the same portion 9 at the end opposite to the one communicating with the internal part of the package 1.

The tubular member 2 has, on its opposite extremities, suitable transversal welding lines, designed to close tightly the package; obviously, the upper welding line is made after the liquid product has been introduced into the package.

More precisely, an upper welding line 15 is provided in correspondence with the front and back faces 3 of the tubular member 2, so as to define the top of the package and to close, e.g. by folding, the sides 4 in the upper part of the package.

As it is clearly seen in the drawing, the height of the detachable portion 9 is suitably reduced so that it is not welded, in the above described way.

The lower welding line 16, not seen in FIG. 1 but seen in FIG. 5, relative to an embodiment to be described later, concerns also the detachable portion 9, so as to close the bottom of the channel compartment 10.

The package bottom obtained in this way, due to the folding of the tubular member 2, gives the package a shape of a bag.

In order to use the beverage contained inside the package 1, the detachable portion 9 must be drawn from the side 4 of the same package and partially detached from the same side along the breaking line 12.

Figure 2:
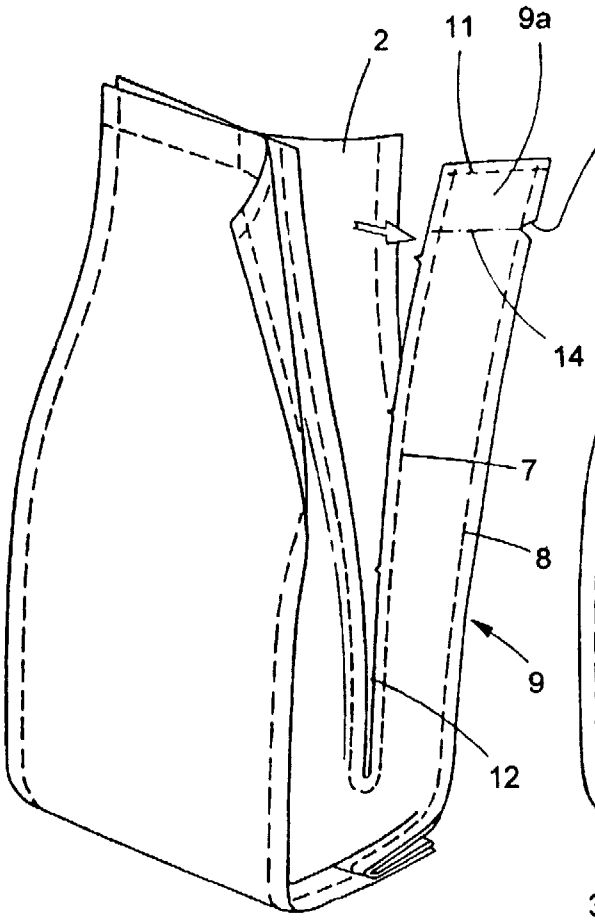
FIG. 2 shows a corresponding perspective view of the package as it looks while opening.

This detachment operation is easily carried out by a limited traction, as the arrow in FIG. 2 indicates.

Therefore, an upper part 9*a* of the portion 9 is torn, in correspondence with the notch 13, thus allowing the top of the channel compartment 10 to be opened as delimited by the portion 9.

Figure 4:
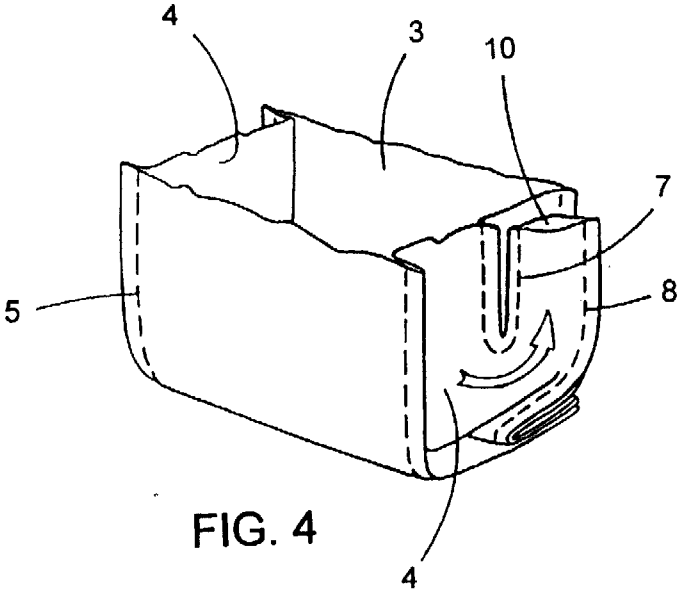
FIG. 4 shows a perspective view of the bottom portion of the package as it appears when in use.

As it is seen in FIG. 4, the channel compartment 10, in its interior end, is in communication with the inside of the package.

Therefore, it is possible to withdraw the beverage contained in the package through the channel compartment 10, either by sucking up or by sucking up and pressing the package, made of flexible material.

Advantageously, possible to provide the detachable portion 9 with a drinking straw 17 of a semi-rigid material, that is situated inside the channel compartment 10 (FIG. 4).

This straw 17 assures better sucking of the beverage, avoiding possible obstructions of the channel compartment 10.

Naturally, the presence of the straw 17 is suitably related to the type of the beverage packed and of the intended consumer.

Figure 5:
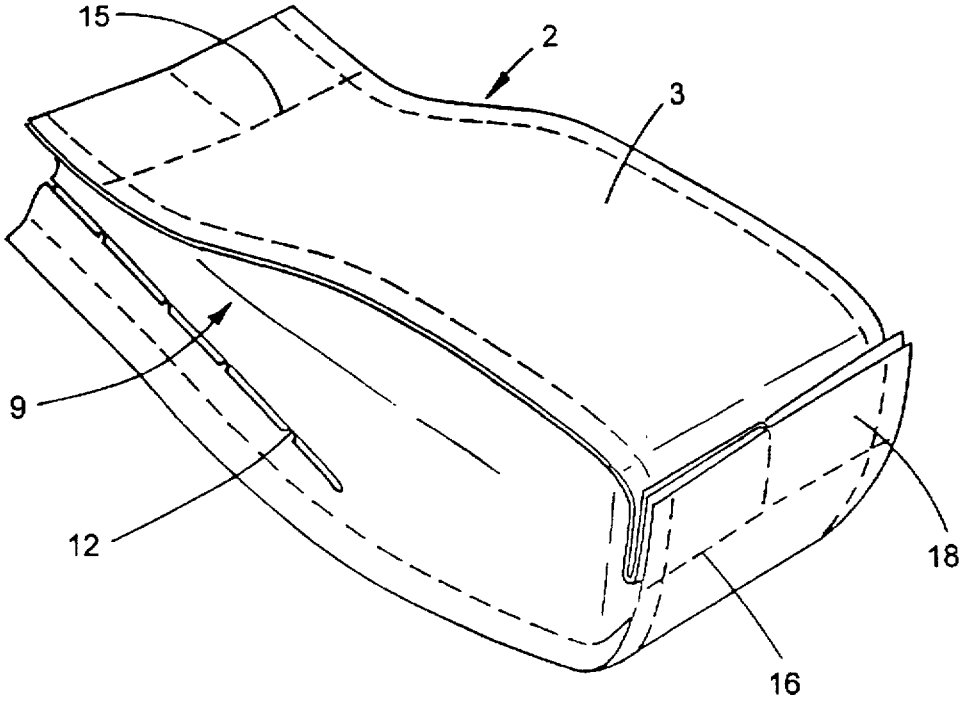
FIG. 5 shows a perspective view of another embodiment of the subject package.

FIG. 5 shows a different embodiment of the subject package, in which the detachable portion 9, forming the channel compartment 10, basically extends along an edge of one of the lateral sides 4 of the same package.

Figure 8:
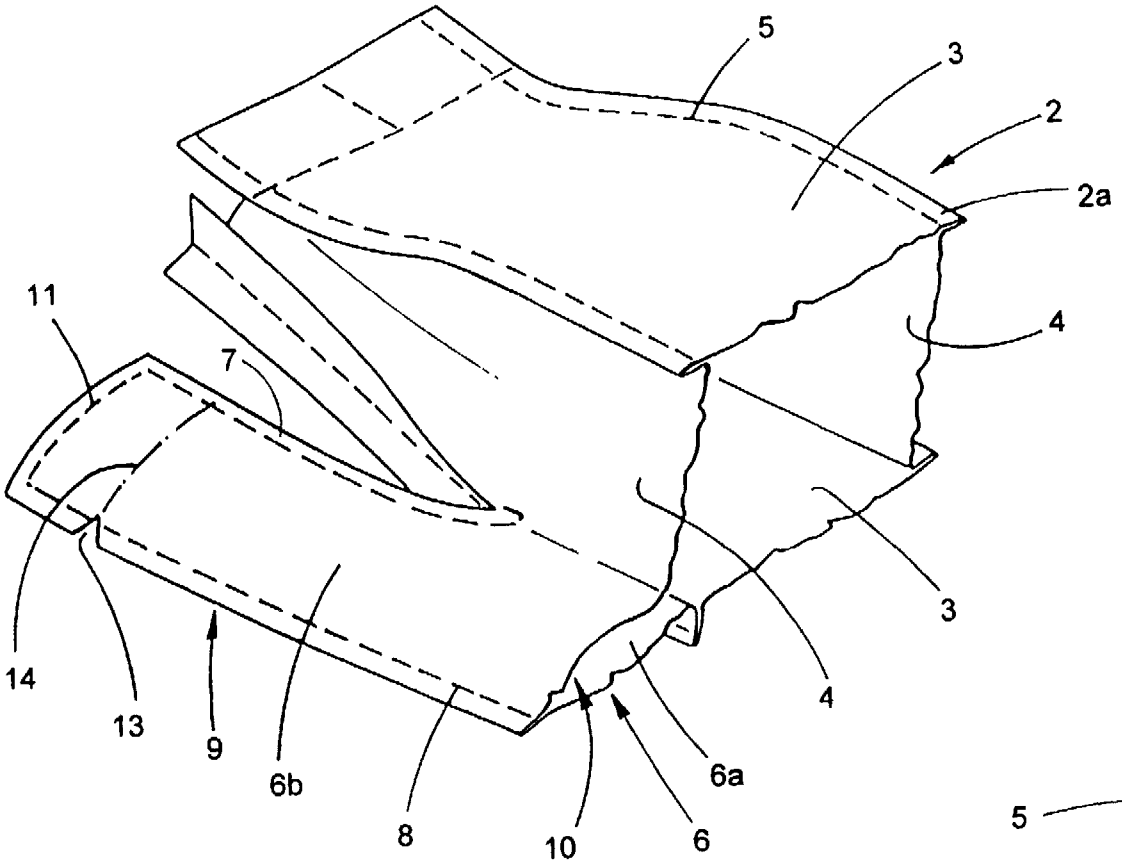
FIG. 8 shows a perspective view of the broken away upper part of the package shown in FIG. 7.

More precisely, as seen in detail in FIG. 8, the above mentioned detachable portion 9 is delimited by a pair of longitudinal strips 6a and 6b extending from the tubular member 2.

The first strip 6a is a continuation of the adjacent frontal face 3 of the tubular member 2, while the second strip 6b is a folded portion of the side 4.

Similarly to what has been previously described, such longitudinal strips 6a, 6b are joined by suitable welding lines 7, 8 which define the portion 9 forming the channel compartment 10, that is closed at one end and having the other end in communication with the inside of the package.

Moreover, the strips 6a, 6b have a breaking line 12 designed to permit the partial detachment of the portion 9 forming the channel compartment 10.

The end of the detachable portion 9 closed by the transversal welding line 11 can be opened in correspondence with the transversal tear notch 13.

It is to be pointed out that in this case the detachable portion 9 is folded very near to the lateral side 4 of the tubular member 2.

The interior part of the same portion 9 is folded against the bottom of the package.

Figure 6:
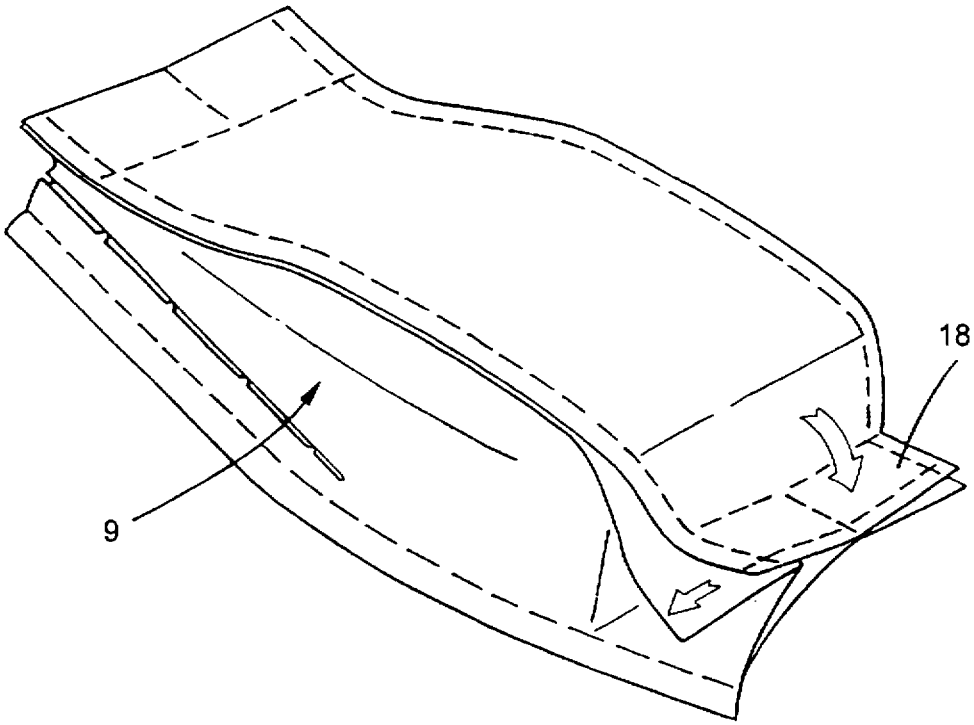
FIGS. 6 and 7 show perspective views of this package respectively in subsequent opening phases.

Therefore, in order to open the package it is necessary to first unfold an edge 18 of the bottom, so as to free the detachable portion 9 (FIG. 6).

Figure 7:
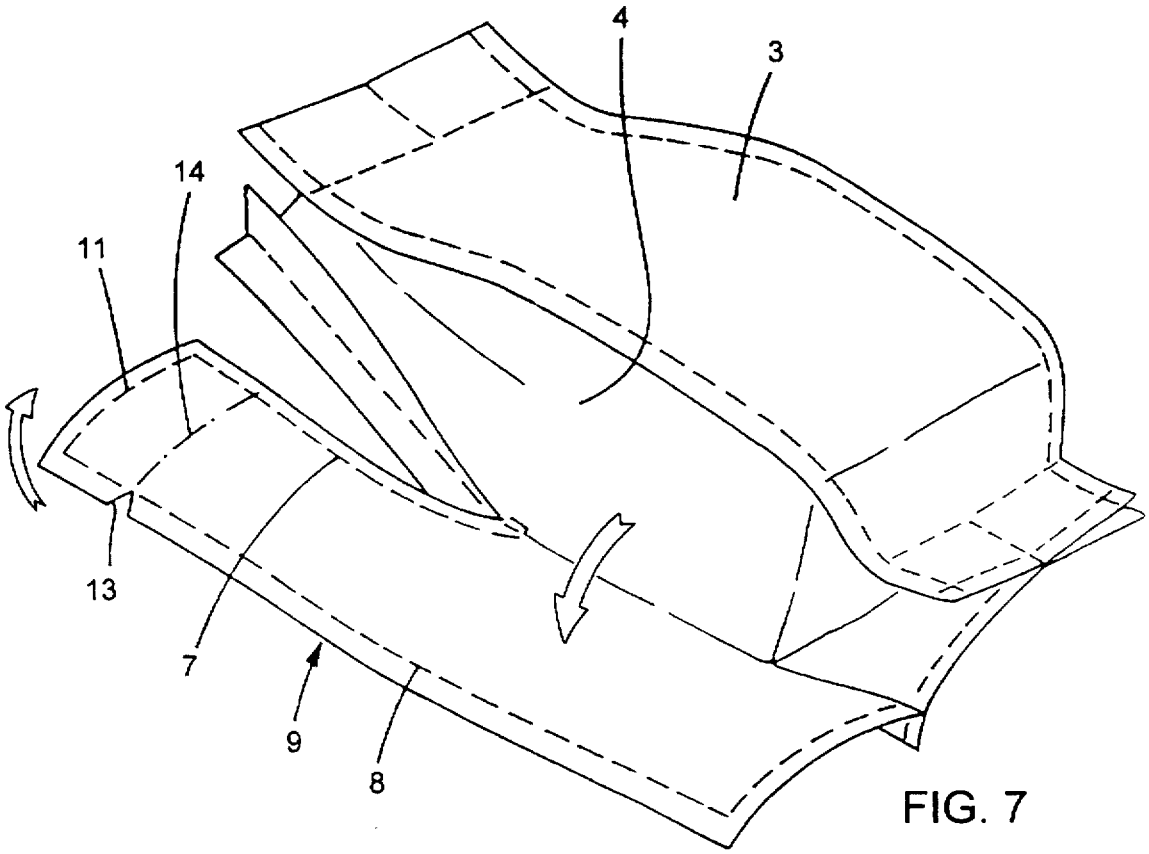

Then, this portion 9 is removed from the packaging position by overturning it, with respect to the side 4, and thus it is opened by tearing (FIG. 7).

Figure 9:
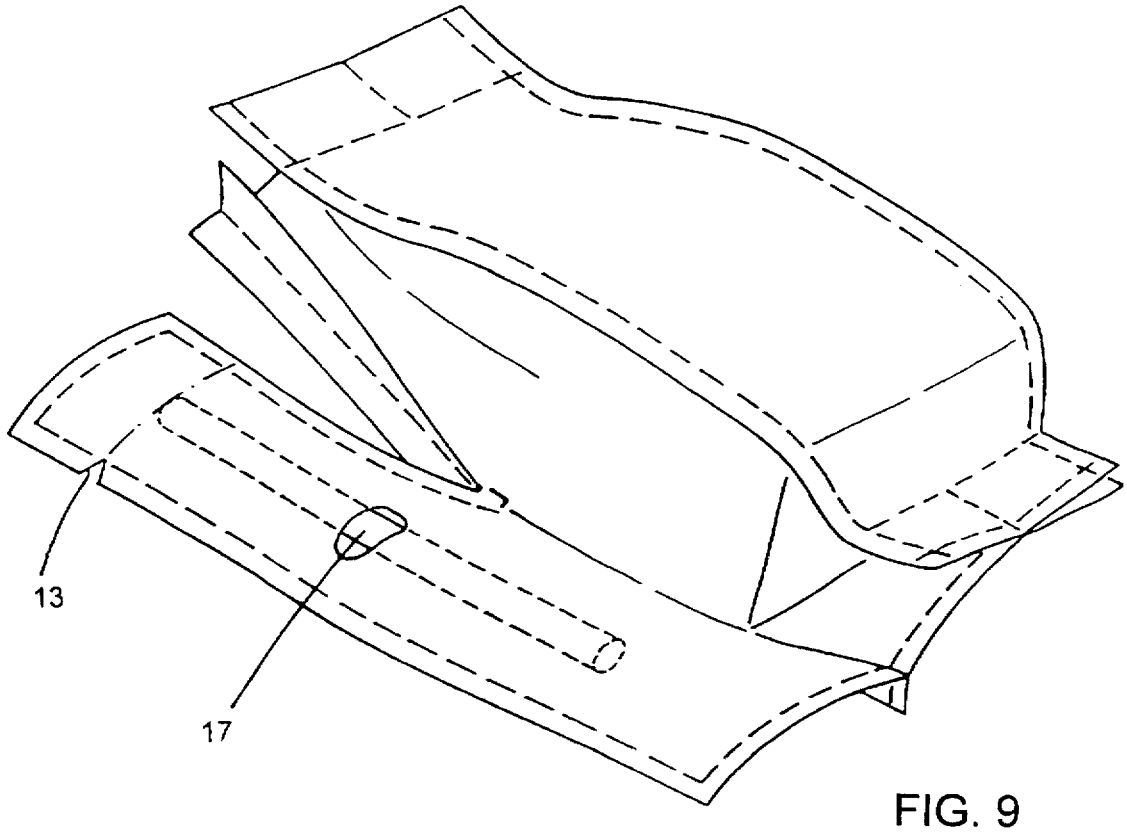
FIG. 9 shows another embodiment of the package in the same situation as the one shown in FIG. 7.

Obviously, also in this embodiment it is possible to insert a drinking straw 17 inside the channel compartment 10 (FIG. 9).

Figure 11:
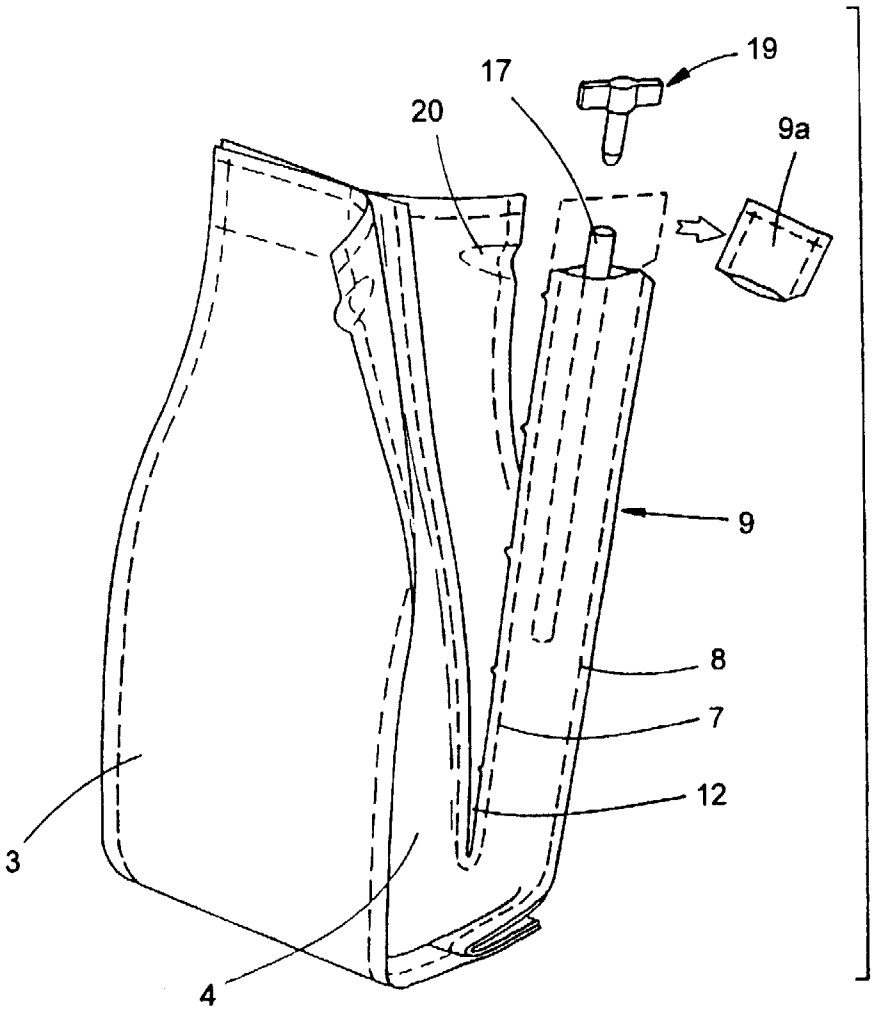
FIG. 11 shows a correspondent perspective view of the package shown in FIG. 10, in its opening phase.
Figure 10:
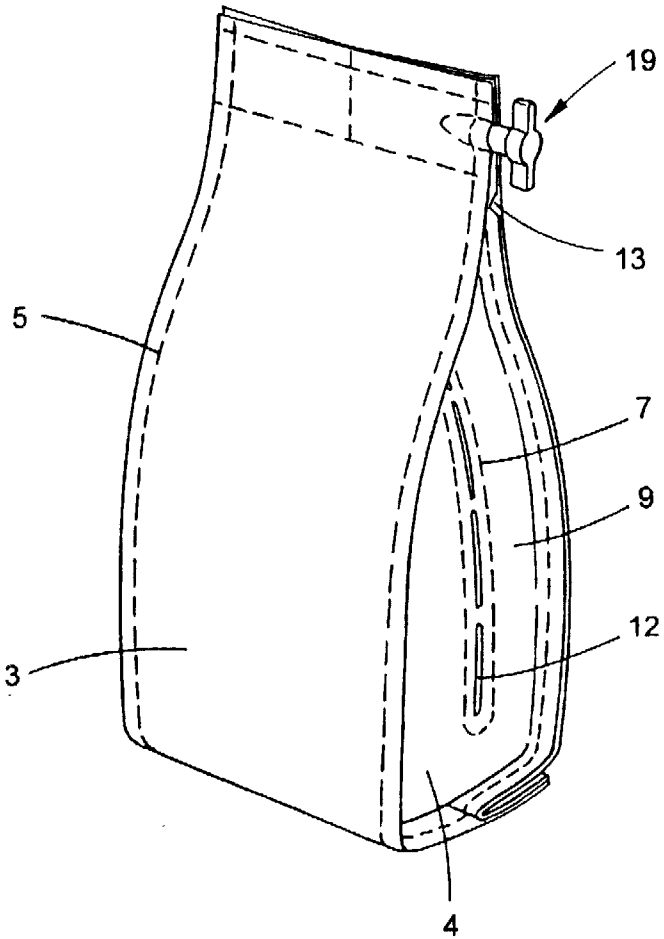
FIG. 10 shows a perspective view of a package provided with a closing stopper.

The package illustrated in FIGS. 10 and 11 is provided with a stopper 19, in a form of a spigot, designed to close the straw 17 inserted in the channel compartment 10 of the detachable portion 9.

The stopper 19 is fitted in a seat 20 defined between the strips of the sides 4 which are accordion folded in the upper part of the package.

In order to use the beverage, it is necessary to pull the detachable part 9 out from the side of the package and to tear the upper part of this portion 9 along the notch 13, thus the top of the straw 17 to be inserted in the channel compartment 10 of the portion 9. (see FIG. 11)

Then, the straw 17 can be closed by the stopper 19, that is press fitted therein, so as to close the package in the case of e.g. partial consumption.

Figure 12:
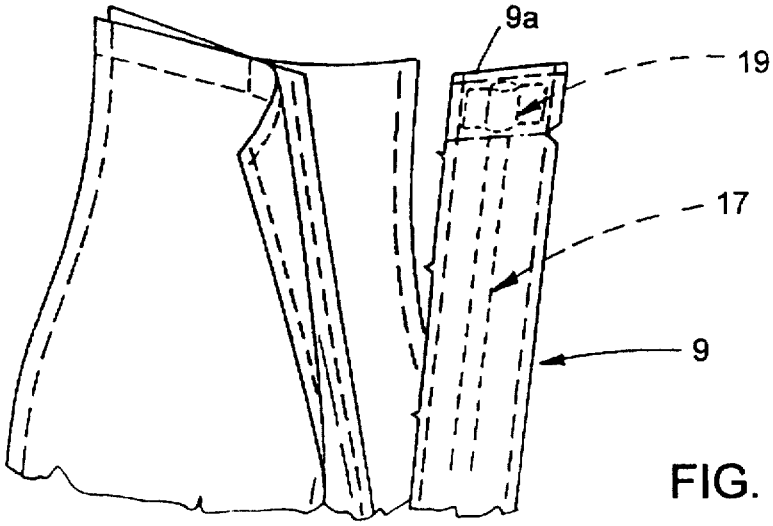
FIGS. 12 and 13 show a partial perspective view of a different embodiment of a package provided with a closing stopper, in subsequent opening phases.
Figure 13:
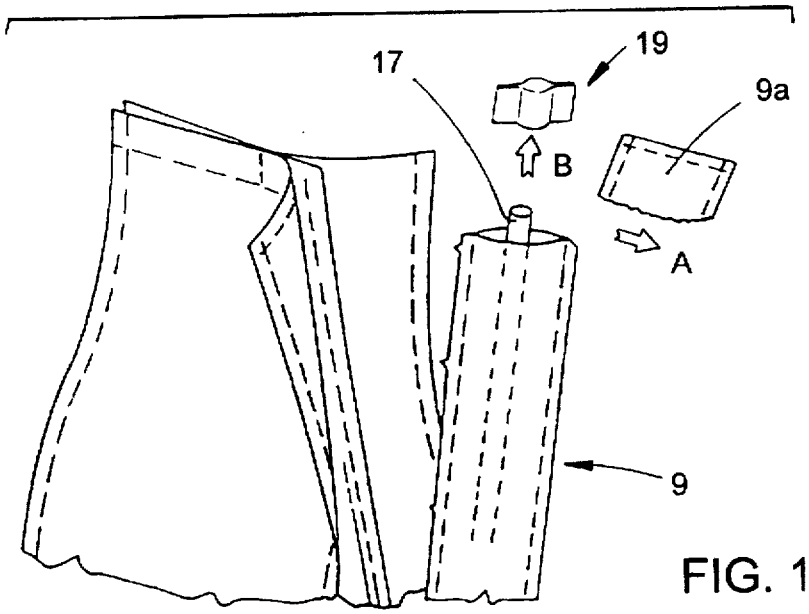

In FIGS. 12 and 13, the stopper 19, in packaging configuration, closes the straw 17 and is held inside a correspondent seat defined by an upper part 9a of the detachable portion 9.

In this case, in order to use the beverage, after having torn the upper part 9a of the portion 9, it is necessary to remove the stopper 19, as indicated with the arrow B in FIG. 13.

The stopper 19 can be subsequently inserted again in the straw 17.

Figure 14:
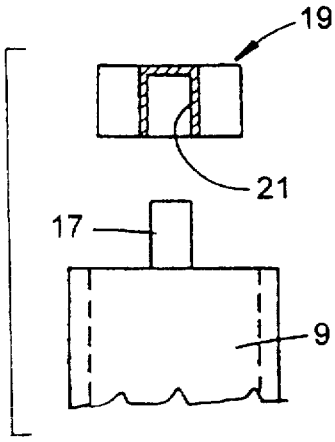
FIGS. 14, 15 and 16 show a schematic view of different embodiments of the closing stopper.

The stopper 19 may have a butterfly shape and form a cavity 21 designed to receive the press-fitted top of the straw 17, protruding over the upper part of the portion 9. (FIG. 14).

Figure 15:
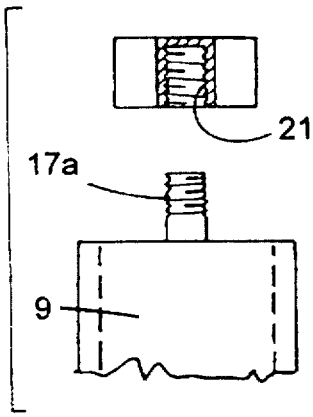

The cavity of the stopper 19 can have a threaded surface 21a, for screwing on a correspondent threaded portion 17a of the straw 17 (FIG. 15).

Figure 16:
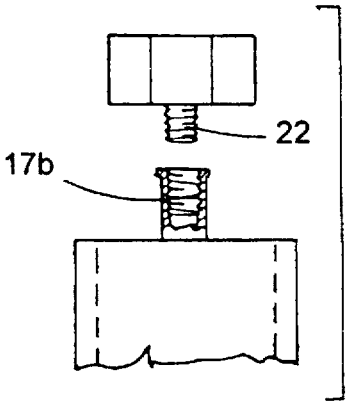

Alternatively, the stopper can be provided with a threaded tang 22 designed to screw in an internal thread 17b made at the top of the straw 17 (FIG. 16).

Obviously, the stopper can have other shapes, different from the illustrated one, e.g. a cylindrical head of hexagonal shape have the like.

Figure 17:
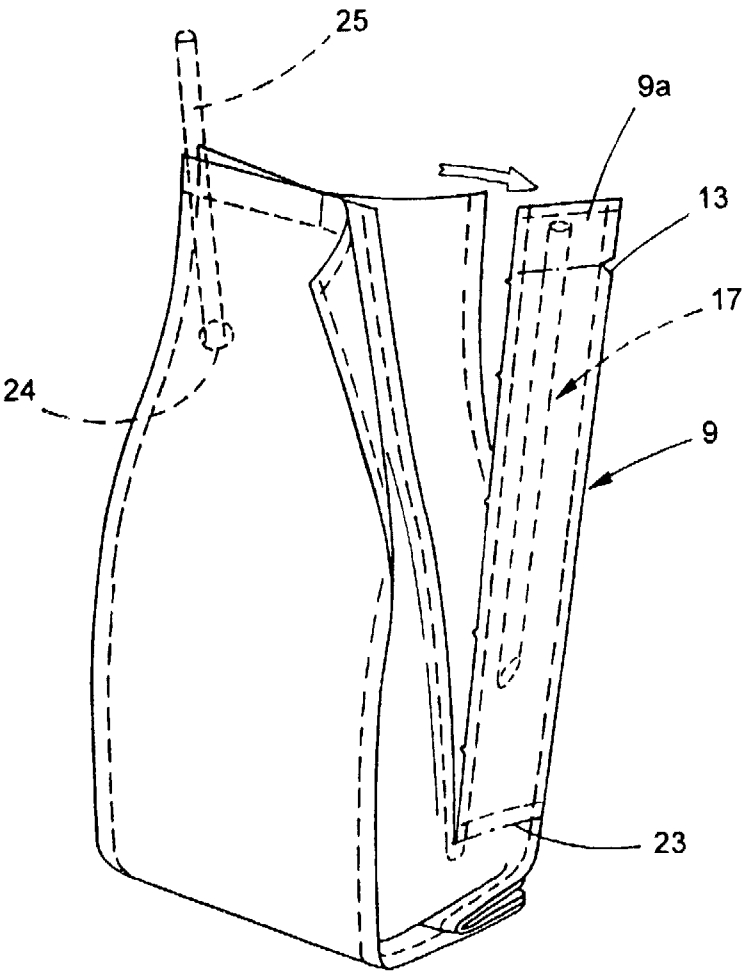
FIG. 17 shows a perspective view of a package provided with a drinking straw.

In the package shown in FIG. 17, the channel compartment 10 formed by the detachable portion 9 is used as the seat of the straw 17 and it is closed in its lower part by a transversal welding 23.

The straw 17 is to be inserted, when used, through a hole 24 made in the top of the package, normally closed by a patch of material that can be broken by inserting the straw.

The straw 17 is withdrawn from the seat after the upper part 9a of the portion 9 is torn, in correspondence with the notch 13 and then, it is inserted through the hole 24, as indicated with the broken line 25.

It is to be pointed out that the straw is kept in a hermetically closed and perfectly aseptic seat, so as to guarantee maximum hygiene.

Figure 18:
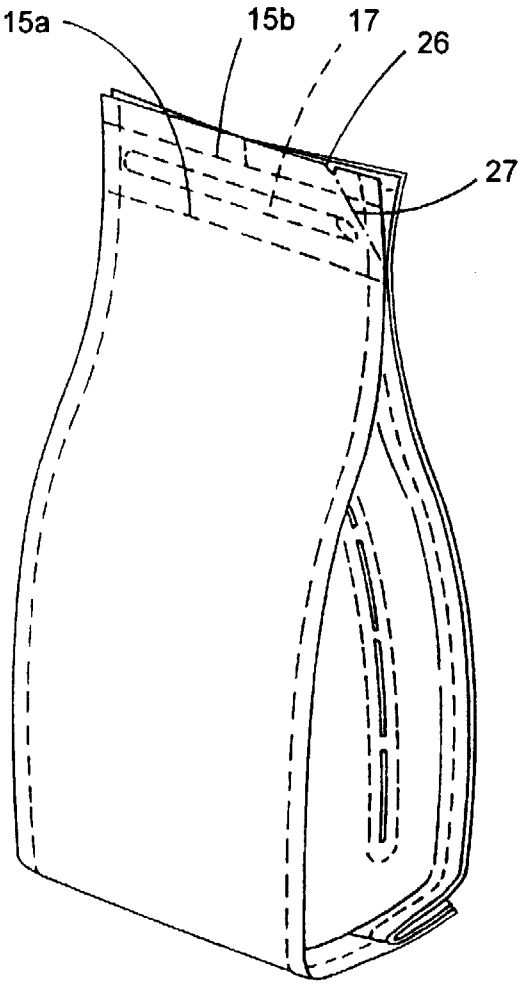
FIGS. 18 and 19 show a perspective view of a different embodiment of this package provided with a straw.
Figure 20:
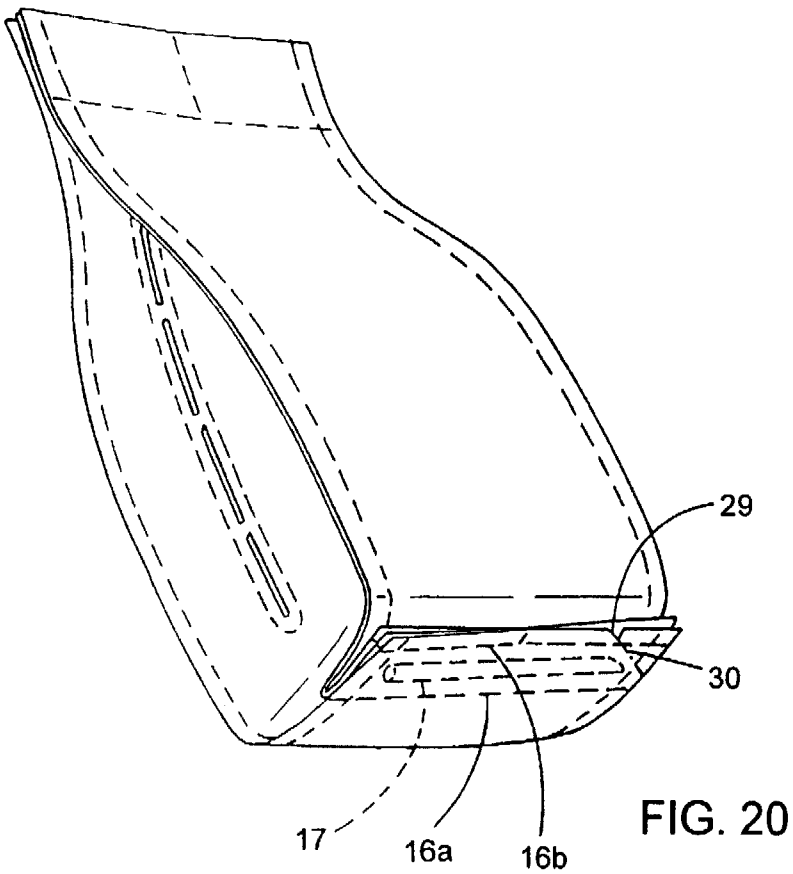
FIG. 20 shows a perspective embodiment of this package provided with a straw.
Figure 19:
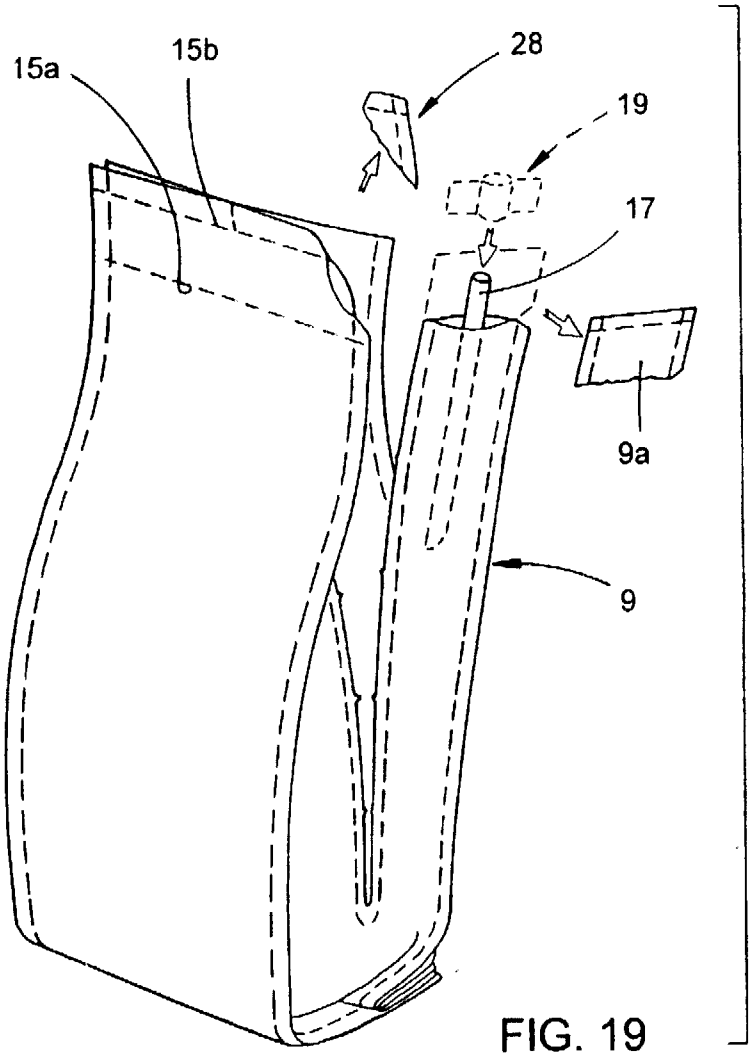

The seat of the straw 17 can be made alternatively in correspondence with the upper or lower end of the tubular member 2, as shown in FIGS. 18, 19 and 20.

The upper seat for the straw is defined between a couple of parallel weldings 15a, 15b, made transversally to the tubular member 2.

A tear notch 26, correspondent to a preferential breaking line 27, is provided in the upper part of the housing for the opening thereof.

Such a breaking line 27 extends slantwise so as to define a removable strip 28. (FIG. 19)

One end of the straw housing is open by tearing off the strip 28, thus allowing for the withdrawal of the straw.

For consuming the beverage, the straw can be inserted in the channel compartment of the detachable portion 9, after having its upper part 9a removed. (FIG. 19)

The package can be provided, as previously mentioned, with a stopper 19 designed to close the straw 17.

Likewise, the lower seat for the straw can be defined between a couple of parallel weldings 16a, 16b, made transversally to the tubular member 2.

A tear notch 29, correspondent to a preferential breaking line 30, is provided marginally for the opening of the housing (FIG. 20).

Figures 21A, 21B, 22:
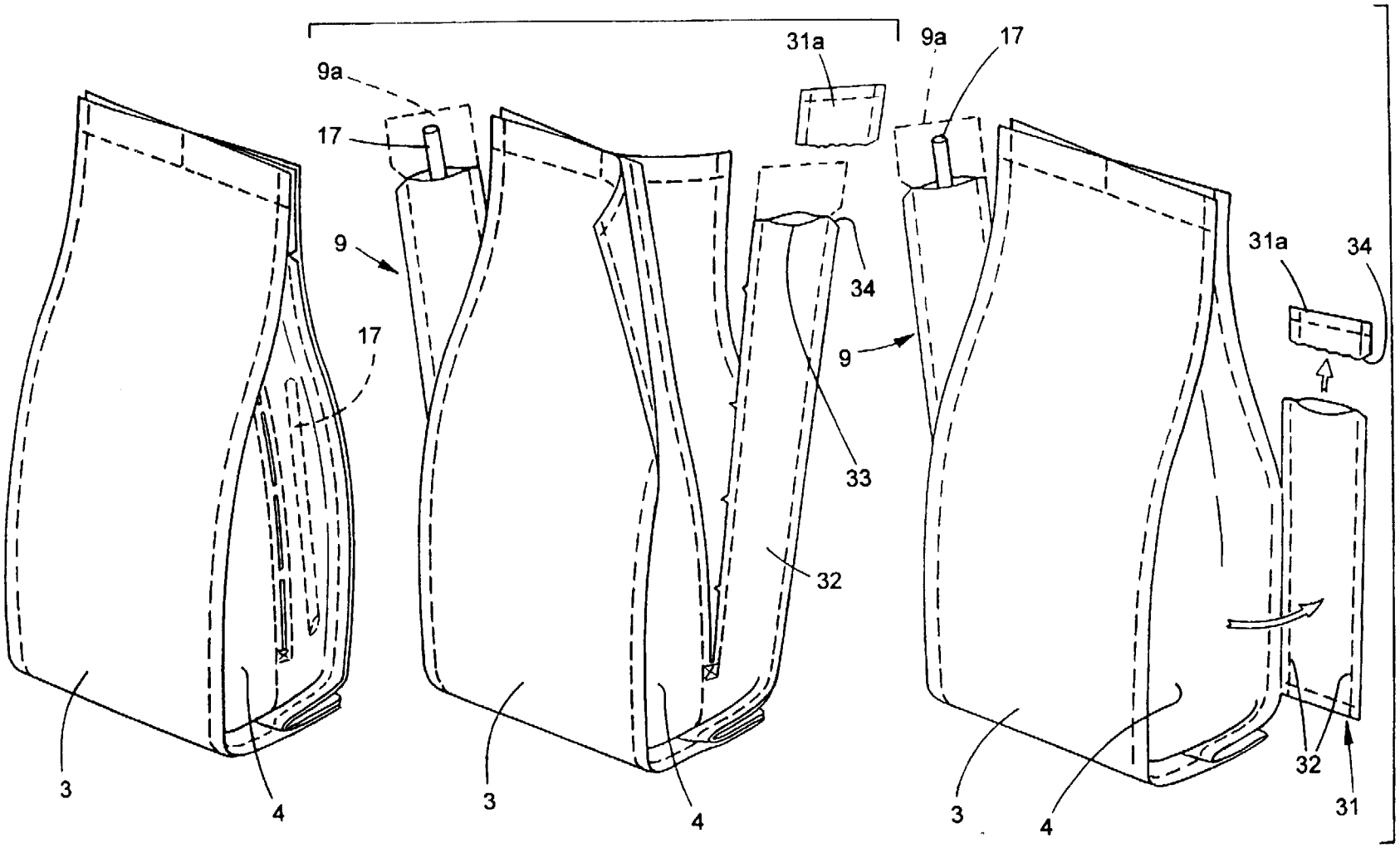
FIGS. 21*a* and 21*b* show a further embodiment of the package provided with a straw.
FIG. 22 shows a still further embodiment of this package provided with a straw.

Finally, the FIGS. 21 and 22 illustrate the solution, in which the straw is housed in a lateral pocket 31, made at the side 4 of the tubular member 2, externally and longitudinally thereto in correspondence to the middle of the same side, by a peripheral welding line 32 designed to define a hermetical housing for the straw 17, thus keeping the same housing isolated from the inside of the package 1.

A pocket 31 has an upper part 31*a* that can be detached in correspondence with a preferential breaking line 33 starting with a tear notch 34.

In order to consume the beverage, the upper part 31*a* of the pocket 31 is torn off, so as to allow for the withdrawal of the straw 17.

Then the straw 17 can be inserted in the channel compartment of the detachable portion 9, made on the opposite side of the package, after the upper part 9*a* of such portion 9 is removed (FIG. 21*b*).

FIG. 22 shows an alternative solution, in which the lateral pocket 31 extends on the edge of one of the sides 4 of the package.

More precisely, the lateral pocket 31 is defined by a couple of longitudinal strips of the tubular member 2 that extend respectively from the side 4 to an adjacent frontal face 3.

Such strips are joined by a welding line 32 designed to delimit the hermetical housing for the straw 17.

In this solution, the pocket 31 has the same detachable upper part 31*a* as in the solution described previously (see FIG. 21*b*).

Also using the beverage of the so made package 1 is identical.

Figure 23:
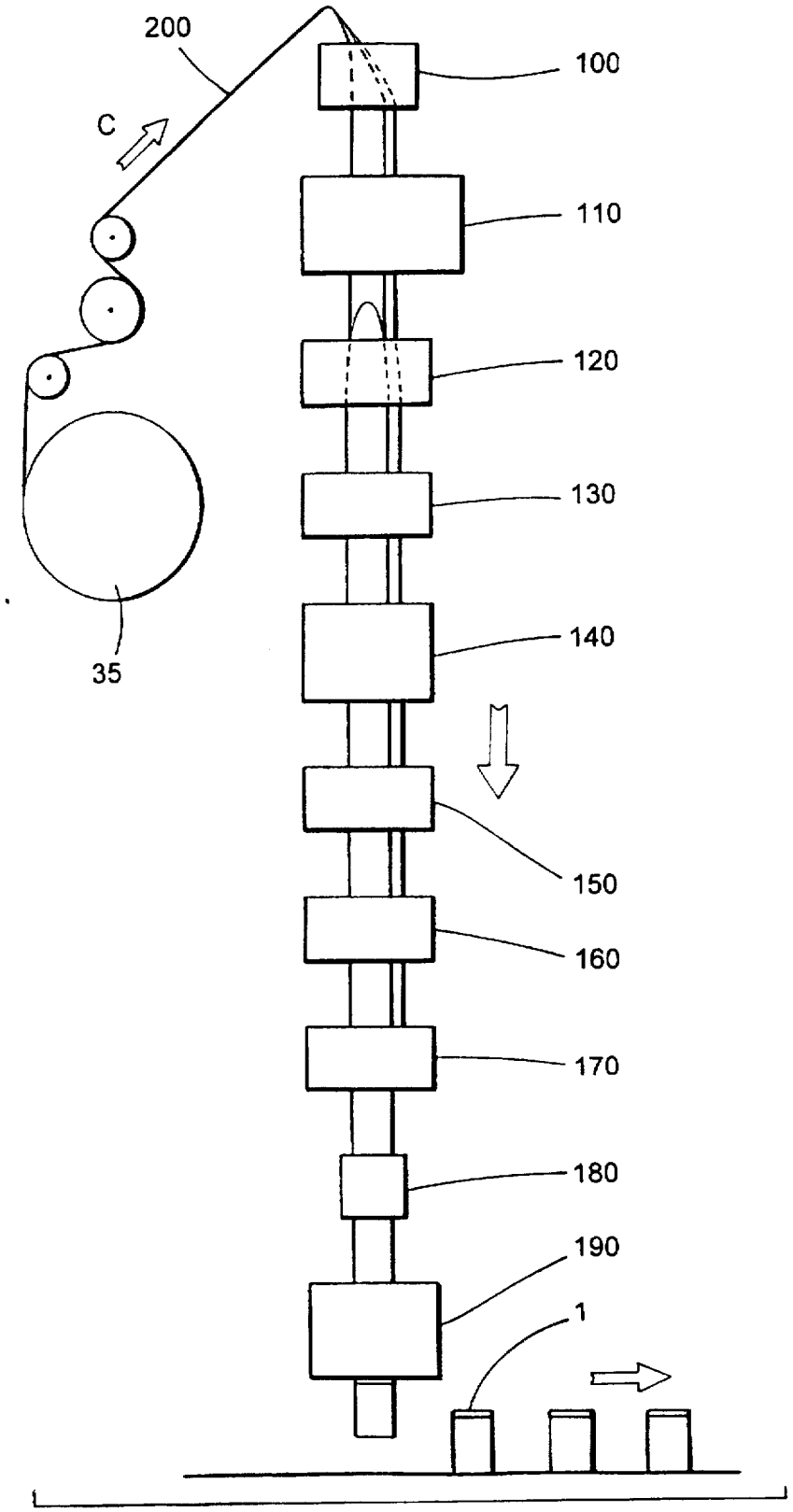
FIG. 23 shows a phase block diagram of the subject method.

FIG. 23 shows schematically the subject method.

As an example , reference is made to producing packages having a straw 17 of semi-rigid material, placed longitudinally inside the channel compartment 10 of the detachable portion 9, as illustrated in FIG. 3.

Such packages are made from a band of flexible material 200, that unrolls from a bobbin 35 in a direction indicated with an arrow C.

Figure 24:
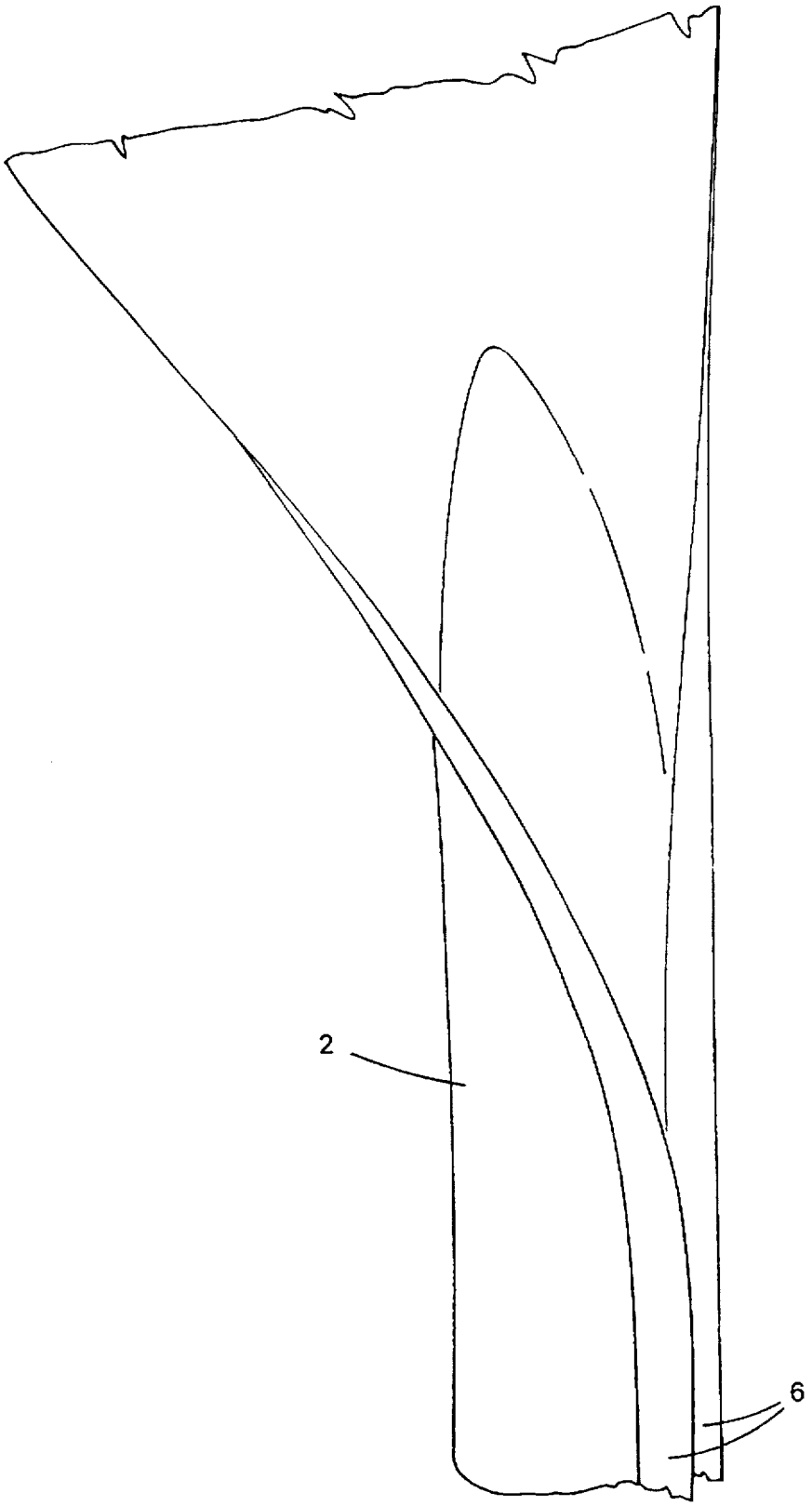
FIGS. 24, 25, 26, 27, 28, 29 and 30 show perspective views of subsequent phases through which this method is carried out.

In a first phase, indicated with 100 in FIG. 23 the band of flexible material 200 is folded in a cylindrical tubular form by known means which are not shown in the figures; at the same time, the longitudinal strips 6, destined to be joined to each other, are folded outwardly (see FIG. 24).

Figure 25:
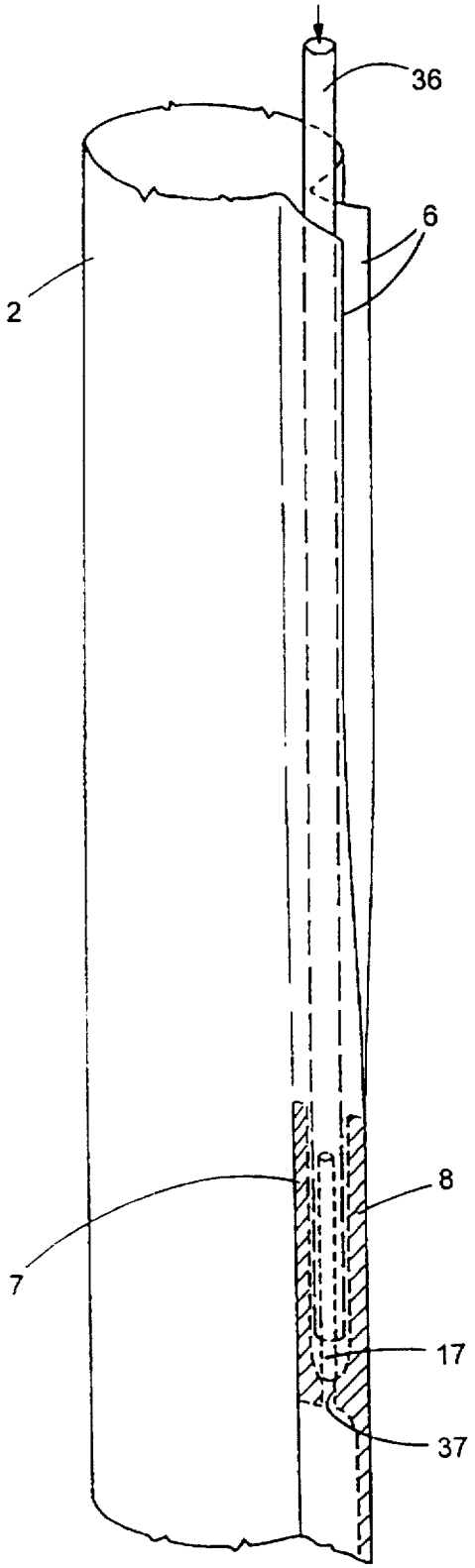

In a second phase 110, the first weldings 7 and 8, respectively internal and external, destined subsequently to form the cited channel compartment 10, are made on the above mentioned strips 6 (FIG. 25).

A flexible hose 36, is inserted longitudinally between the strips 6, and is used to form this channel compartment 10 (FIG. 25).

This hose 36 is used also for introducing the straw 17; after the straw has been introduced, the hose 36 is withdrawn from the channel compartment 10, formed by the weldings 7 and 8, due to the advancement of the tubular member 2.

It is to be pointed out that the weldings 7 and 8 form, in the lower part, a necking 37, against which the straw 17 is pushed in abutment.

Figure 26:
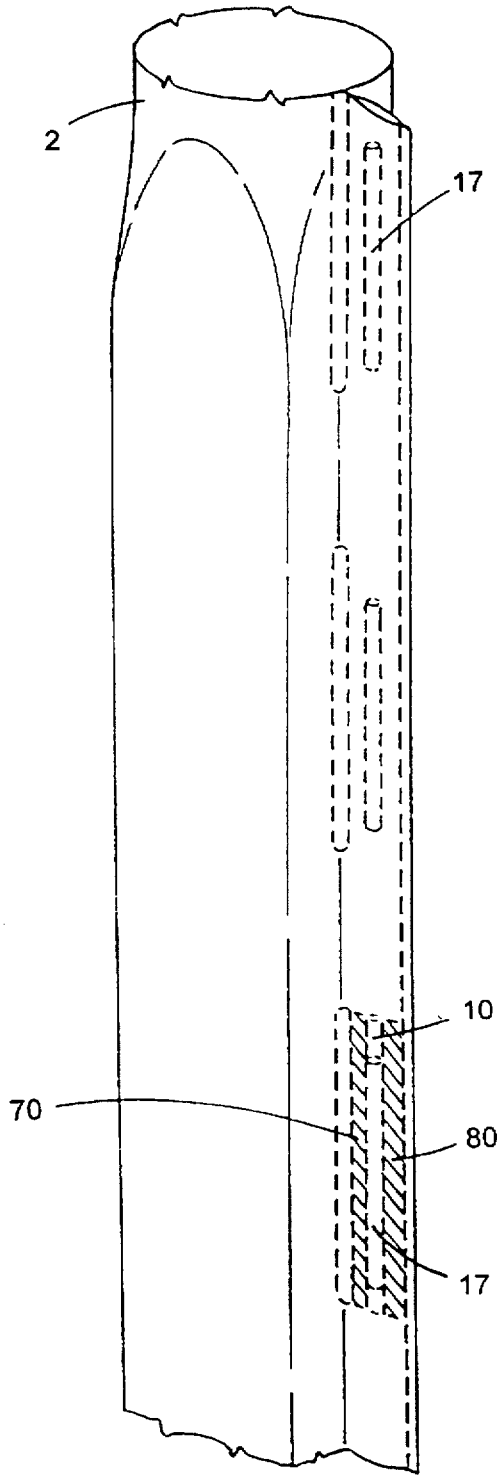

In the subsequent phases 120 and 130, the tubular member 2 is made rectangular and then, on its longitudinal strips 6, there are made further weldings 70, 80, internal in respect to the first weldings 7, 8 and designed to narrow the channel compartment 10 so as to render it adherent to the straw 17 (FIG. 26).

Figure 27:
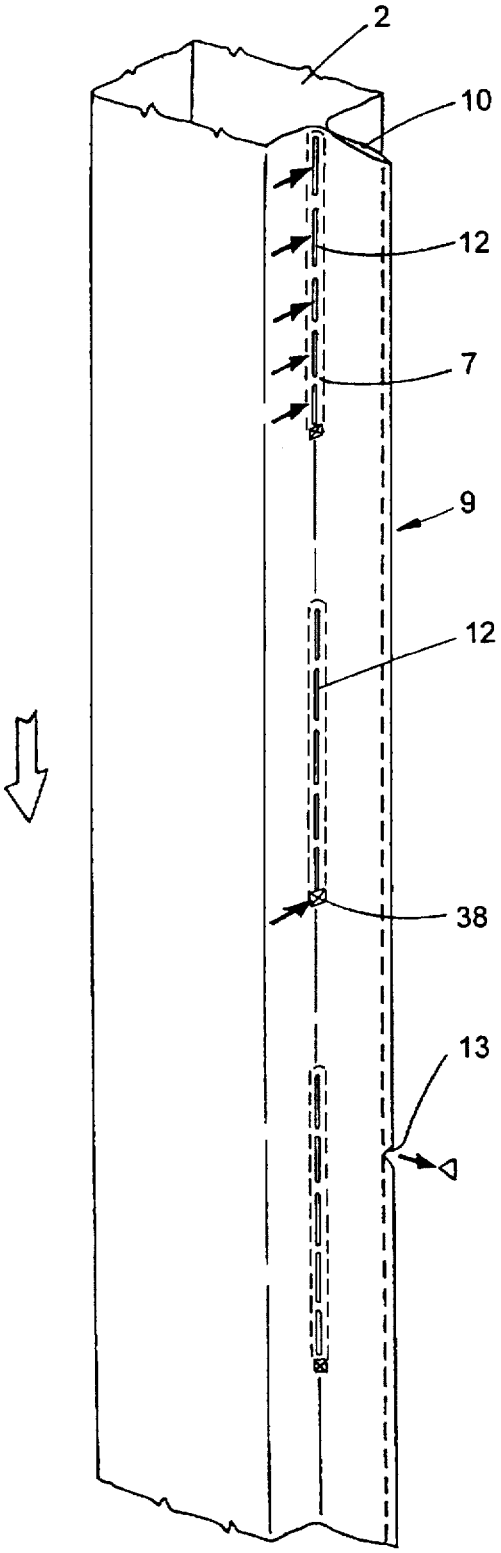

In the phase 140, the longitudinal breaking line 12 is made in correspondence with the internal welding 7, the breaking line 12 allowing the portion 9, forming the channel compartment 10, to detach partially when the package 1 is used (FIG. 27).

Subsequently, a stiffening wrinkling 38 is made at the base of the breaking line 12, and the transversal tear notch is made on the external edge.

Figure 28:
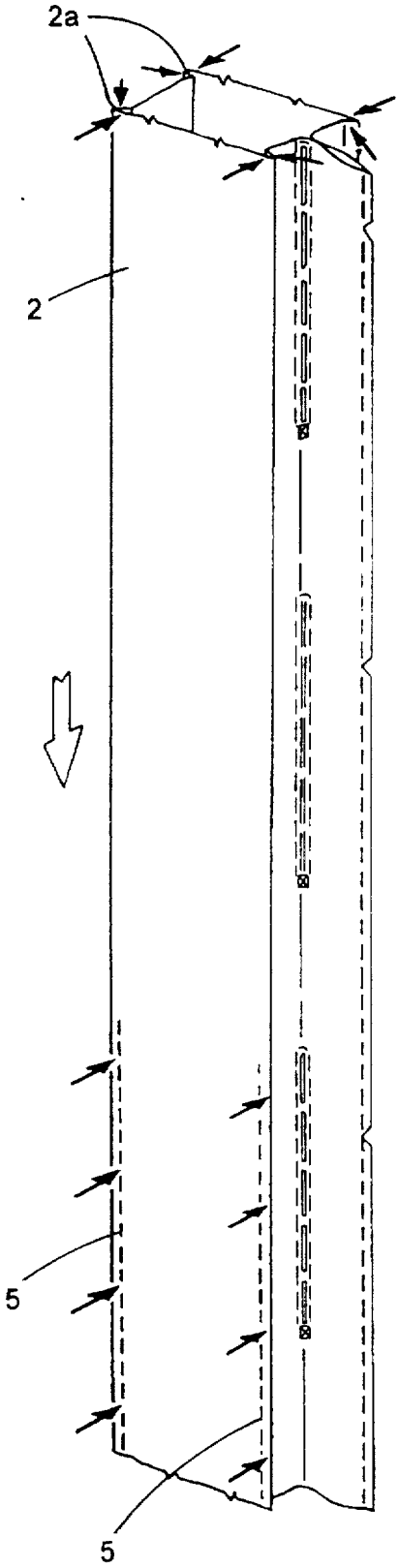

In the phases 150 and 160, the folded angles 2*a* are made on the corners of the tubular member 2 and afterwards, the welding lines 5 are made in order to stiffen these angles 2*a* (FIG. 28).

Figure 29:
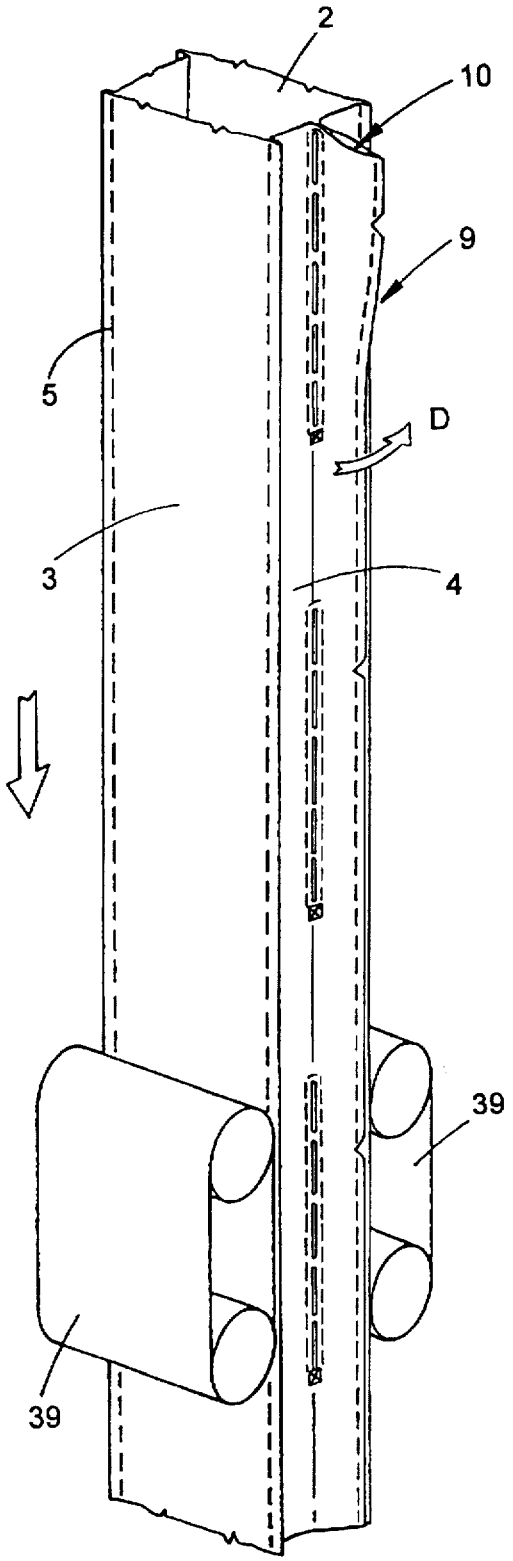

In the phase 170, the portion 9, that forms the channel compartment 10, is laterally folded on the correspondent side 4 of the tubular member 2, as indicated with the arrow D in FIG. 29.

FIG. 29 shows also belt means 39 pulling flexible material 200 to that consequently cause stretching of the frontal faces 3 of the tubular member 2 in correspondence with the phase 180.

Figure 30:
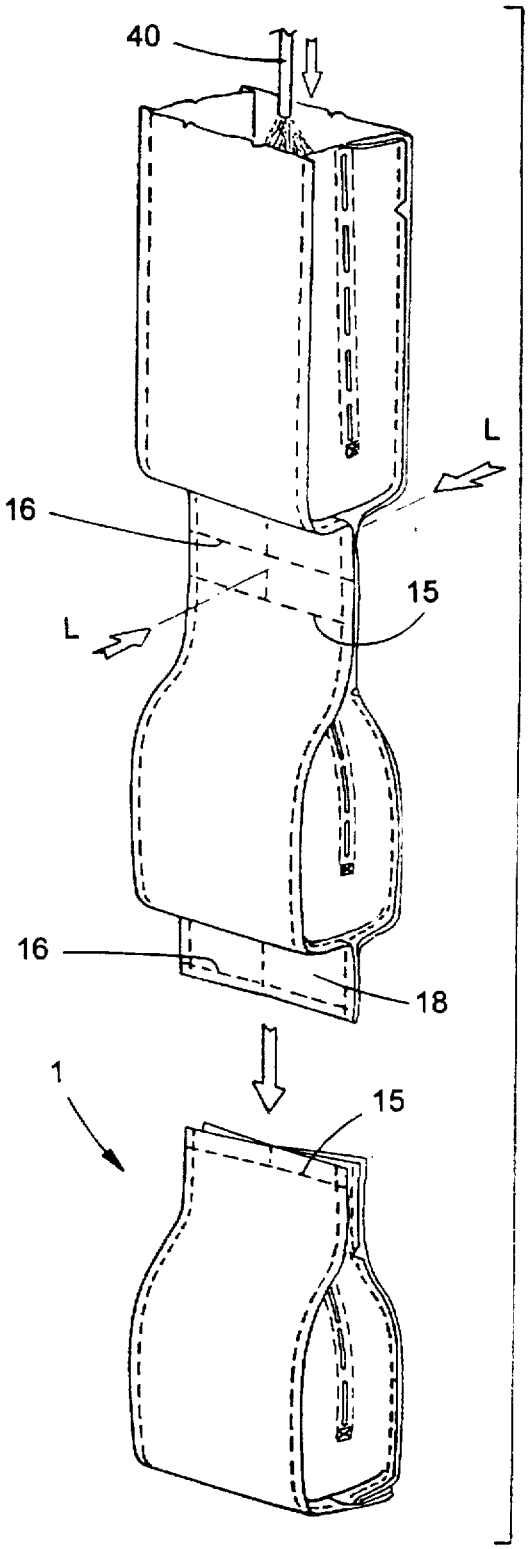

Finally, in the phase 190, the bottom of the package 1 is formed, in such a way so as to permit its filling with a measured quantity of product, through a suitable feeding duct 40 (FIG. 30).

Known and suitable means acting according to the arrows L of the FIG. 30 fold in accordion shape the tubular member 2 in correspondence with the head of the package 1 and the bottom of the following package.

Afterwards, the transversal weldings 15 and 16 are made, that close the head of the just filled package 1 and the bottom of the following package to be filled.

Lastly, the package 1, made from the tubular member 2, is severed between the welding lines 15 and 16, and the edge 18 is folded on the above mentioned bottom of the package 1 (see again FIG. 30).

Then, the packages 1 are sent to a conventional conveying line.

The package for liquid products made according to the subject method provides the proposed objects of productive economy and functionality.

In particular, the described package has a very reduced production cost, considerably lower as compared to the packages known at present, obtained due to the use of relatively cheap materials, and production simplicity, since only a limited number of foldings and weldings are made on a sheet of flexible material.

Such material is also recyclable, for the benefit of the environment.

It is to be particularly pointed out, that it is very easy to open the described package and consume the beverage contained therein.

It is to be noticed in particular way, that the subject package allows, ease in withdrawing all the beverage.

In fact, unlike conventional packages, in the described subject package, the channel compartment 10, through which the beverage is taken out, is in communication with its bottom.

Another essential advantage of the package results from the fact that it is self-supporting, since it has the shape of a bag and its interior transversal welding lines are folded to the bottom in such a way that they constitute a solid support base.

The package can be also equipped, according to the intended use, with a closing stopper and/or a drinking straw.

It is to be pointed out that this straw is kept in a hermetically closed housing, so as to guarantee maximum hygiene.

It is understood that what above has been described is a mere example, not limitative, and therefore possible constructive variants are protected by the present technical solution, as described above and claimed in the following.

I claim:

1. A method for manufacturing a package for a liquid food product, said method comprising the steps of:

unrolling a flexible sheet material, from a web (35), mutually juxtaposing longitudinal strips (6) of the sheet material, folding the sheet into a tubular member (2) such that said longitudinal strips (6) are turned outwards;

providing an internal longitudinal welding line (7) and an external longitudinal welding line (8), on said longitudinal strips (6) to join the strips to one another, to define a detachable portion (9), in the form of a channel compartment (10);

forming folded edges (2a) at corners of the tubular member (2) to form a substantial parallele piped-shaped package (1) having a pair of opposite sides (4), a pair of opposite faces (3), a bottom and a top, the channel compartment having a lower end in communication with an inside of the package (1);

stiffening the folded edges (2a) by providing longitudinal welding lines (5);

making a transversal weld on a bottom end of the tubular member (2), at least one transversal lower welding line (16) extending over the detachable portion (9) to define the bottom of the package (1);

dosing the liquid food product into the tubular member (2), folding the detachable portion (9) onto a corresponding side (4) of said tubular member (2);

transversely welding a top end of the tubular member (2), at least one transversal upper welding line (15) defining a sealed top of said package (1).

2. The method according to claim 1, further comprising, after providing the internal and external longitudinal welding lines, and before forming the folded edges (2a), the steps of:

inserting a flexible hose (36) between the joined strips (6), into the channel (10);

inserting a drinking straw (17) inside the flexible hose (36) until the straw (17) strikes a necking (37) formed at a bottom of the internal and external welding lines;

withdrawing the flexible hose (36) from the channel compartment (10); and, providing additional welding (70, 80) inwardly of the internal welding line(7) and the external welding line (8) to narrow the channel compartment (10).

3. The method according to claim 2, further comprising, before inserting the flexible hose (36) between the joined strips (6), the step of providing a transversal welding (23) next to the lower end of the channel compartment (10).

4. The method according to claim 2, further comprising the step of providing a seat (20) between the sides (4) of said tubular member (2), by folding the sides onto each other, in an upper part of the package, the seat (2) sized to contain a stopper (19), the seat formed between a pair of transversal weldings (15) made sideways thereto.

5. The method according to claim 1 further comprising, before forming the folded edges, the steps of providing a longitudinal breaking line (12) on the internal longitudinal welding line for allowing the portion (9) to be partially detached from the package (1).

6. The method according to claim 5, further comprising providing a stiffening wrinkling (38) at a lower end of the breaking line (12).

7. The method according to claim 1 further comprising, before folding the detachable portion (9), the step of providing a traversal notch (13) onto the external welding line, the notch (13) provided by a preferential breaking line (14), the notch allowing the detachable portion (9) to be opened at an end opposite to the lower end in communication with the inside of the package (1).

8. Method according to claim 1, further comprising making a first traversal welding (15a) in the top end of the tubular member to form an upper seat of the package (1);

inserting a drinking straw (17) inside the upper seat;

providing a second transversal welding (15b) of the top end of said tubular member (2), parallel to the first welding (15a) and opposite thereto with respect to the straw (17, to seal the upper seat.

9. The method according to claim 8 further comprising providing a breaking line end that delimits a tear-off strip (28) having a tear notch at one end thereof that can be removed to open the upper seat.

10. The method according to claim 1, further comprising providing a first transversal welding (16a) in the bottom of the package, to form a lower seat;

inserting a drinking straw (17) inside the lower seat;

providing a second transversal welding (16b) in the bottom of the package parallel to the first welding (16a) and opposite thereto with respect to the straw (17) to seal the lower seat.

11. The method according to claim 10 further comprising providing a breaking line end that delimits a tear-off strip (28) having a tear notch at one end thereof that can be removed to open the lower seat.

12. The method according to claim 1, wherein the joining of said longitudinal strips (6) extends along a midline of one of said sides (4) of the tubular member (2).

13. The method according to claim 1, further comprising joining a first strip (6a) which is an extension of one of said opposite faces (3) of said tubular member (2), and a second strip (6b) which is obtained by folding one of said sides (4) of the tubular member (2).

14. The method according to claim 1, further comprising, before dosing the liquid product inside the tubular member (2), the steps of:

providing a lateral pocket (31) having an open end, the pocket being external to said tubular member (2) at a side (4) which is opposite to the side (4) that carries the portion (9), said lateral pocket (31) being delimited by a couple of longitudinal strips extending from said tubular member (2);

inserting a drinking straw (17) inside the lateral pocket (31) through its open end, the straw (17) being sized to be inserted into the channel compartment (10);

closing hermetically the pocket (31) by a peripheral welding line (32); and providing a preferential breaking line (33) with a tear notch (34) next to an upper portion (31a) of the lateral pocket (31).

15. The method according to claim 1, further comprising, before dosing the liquid product inside the tubular member (2), the steps of:

providing an external lateral pocket (31) having an open end, in a first side (4) of the tubular member (2), in correspondence to a median line of the side opposite to the side (4) carrying the portion (9), said lateral pocket (31) formed by a couple of longitudinal strips extending from the first side (4) and from an adjacent front face (3) of the tubular member (2);

inserting a drinking straw (17) inside the lateral pocket (31) through its open end, the straw (17) being sized to be inserted into said channel compartment (10);

hermetically closing the pocket (31) by a peripheral welding line (32);

providing a preferential breaking line (33) with a tear notch (34) next to an upper portion (31*a*) of the lateral pocket (31).

* * * * *